US009978394B1

(12) United States Patent
Su

(10) Patent No.: US 9,978,394 B1
(45) Date of Patent: May 22, 2018

(54) NOISE SUPPRESSOR

(71) Applicant: Huan-Yu Su, Irvine, CA (US)

(72) Inventor: Huan-Yu Su, Irvine, CA (US)

(73) Assignee: QOSOUND, INC., San Clemente, CA (US)

( * ) Notice: Subject to any disclaimer, the term of this patent is extended or adjusted under 35 U.S.C. 154(b) by 0 days. days.

(21) Appl. No.: 14/629,864

(22) Filed: Feb. 24, 2015

Related U.S. Application Data

(60) Provisional application No. 61/951,224, filed on Mar. 11, 2014, provisional application No. 61/951,239, filed on Mar. 11, 2014.

(51) Int. Cl.

| | |
|---|---|
| ***G10L 21/0364*** | (2013.01) |
| ***G10L 25/93*** | (2013.01) |
| ***G10L 21/0232*** | (2013.01) |
| *G10L 21/0216* | (2013.01) |

(52) U.S. Cl.
CPC ..... *G10L 21/0364* (2013.01); *G10L 21/0232* (2013.01); *G10L 25/93* (2013.01); *G10L 2021/02163* (2013.01)

(58) Field of Classification Search
CPC ..... G10L 21/0216; G10L 2021/02163
See application file for complete search history.

(56) References Cited

U.S. PATENT DOCUMENTS

| | | | | |
|---|---|---|---|---|
| 5,839,101 | A * | 11/1998 | Vahatalo | G10L 21/0208 704/217 |
| 9,484,043 | B1 * | 11/2016 | Su | G10L 21/0208 |
| 2006/0184362 | A1 * | 8/2006 | Preuss | G10L 15/20 704/233 |
| 2009/0063143 | A1 * | 3/2009 | Schmidt | G10L 21/0208 704/233 |
| 2010/0088092 | A1 * | 4/2010 | Bruhn | G10L 19/26 704/228 |
| 2012/0197636 | A1 * | 8/2012 | Benesty | G10L 21/0232 704/226 |
| 2013/0035933 | A1 * | 2/2013 | Hirohata | G10L 15/20 704/206 |
| 2013/0185078 | A1 * | 7/2013 | Tzirkel-Hancock | G10L 15/22 704/275 |
| 2013/0197904 | A1 * | 8/2013 | Hershey | G10L 21/0216 704/226 |
| 2013/0238327 | A1 * | 9/2013 | Nonaka | G10L 21/0216 704/233 |

(Continued)

*Primary Examiner* — Douglas Godbold
(74) *Attorney, Agent, or Firm* — Keith Kind

(57) ABSTRACT

Provided is a method, non-transitory computer program product and system for an improved noise suppression technique for speech enhancement. It operates on speech signals from a single or multiple input sources. Background noise monitoring is performed with one or multiple input speech signals to determine if the input speech contains active voice. If the absence of active voice is detected, the spectrum of the input speech is used to update a long-term noise spectrum estimate. In addition, the input from one or more secondary microphones can be used to update a short-term noise spectrum estimate. The input speech spectrum is then compared to the long-term and/or short-term noise spectra, and a selective spectrum gain based shaping is applied to the input speech spectrum to reduce noise.

3 Claims, 14 Drawing Sheets

(56) References Cited

U.S. PATENT DOCUMENTS

2015/0262590 A1* 9/2015 Joder ..... G10L 21/0232
704/201
2015/0302865 A1* 10/2015 Pilli ..... H04L 65/604
704/205

* cited by examiner

NOISE SUPPRESSOR

CROSS REFERENCE TO OTHER APPLICATIONS

The present application is related to co-pending U.S. patent application Ser. No. 13/975,344 entitled "METHOD FOR ADAPTIVE AUDIO SIGNAL SHAPING FOR IMPROVED PLAYBACK IN A NOISY ENVIRONMENT" filed on Aug. 25, 2013 by HUAN-YU SU, et al., co-pending U.S. patent application Ser. No. 14/193,606 entitled "IMPROVED ERROR CONCEALMENT FOR SPEECH DECODER" filed on Feb. 28, 2014 by HUAN-YU SU, co-pending U.S. patent application Ser. No. 14/534,531 entitled "ADAPTIVE DELAY FOR ENHANCED SPEECH PROCESSING" filed on Nov. 6, 2014 by HUAN-YU SU, co-pending U.S. co-pending patent application Ser. No. 14/534,472 entitled "ADAPTIVE SIDETONE TO ENHANCE TELEPHONIC COMMUNICATIONS" filed on Nov. 6, 2014 by HUAN-YU SU and co-pending U.S. patent application Ser. No. 14/629,819 entitled "NOISE SUPPRESSOR" filed concurrently herewith by HUAN-YU SU. The above referenced pending patent applications are incorporated herein by reference for all purposes, as if set forth in full.

FIELD OF THE INVENTION

The present invention is related to audio signal processing and more specifically to system and method and computer-program product for improving the audio quality of voice calls in a communication device.

SUMMARY OF THE INVENTION

The improved quality of voice communications over mobile telephone networks have contributed significantly to the growth of the wireless industry over the past two decades. Due to the mobile nature of the service, a user's quality of experience (QoE) can vary dramatically depending on many factors. Two such key factors include the wireless link quality and the background or ambient noise levels. It should be appreciated, that these factors are generally not within the user's control. In order to improve the user's QoE, the wireless industry continues to search for quality improvement solutions to address these key QoE factors.

In theory, ambient noise is always present in our daily lives and depending on the actual level, such noise can severely impact our voice communications over wireless networks. A high noise level reduces the signal to noise ratio (SNR) of a talker's speech. Studies from members of speech standard organizations, such as 3GPP and ITU-T, show that lower SNR speech results in lower speech coding performance ratings, or low MOS (mean opinion score). This has been found to be true for all LPC (linear predictive coding) based speech coding standards that are used in wireless industry today.

Another problem with high level ambient noise is that it prevents the proper operation of certain bandwidth saving techniques, such as voice activity detection (VAD) and discontinuous transmission (DTX). These techniques operate by detecting periods of "silence" or background noise. The failure of such techniques due to high background noise levels result in the unnecessary bandwidth consumption and waste. One reason for this problem is due to the fact that conventional systems tend to classify high level noises as active voice. Since the standardization of EVRC (enhanced variable rate codec, IS-127) in 1997, the wireless industry had embraced speech enhancement techniques based on noise cancellation or noise suppression techniques.

Traditional noise suppression techniques are typically based on the manipulation of speech signals in the spectrum domain, including techniques such as spectrum subtraction and the like. While such those prior-art techniques have gained a broad acceptance and have been deployed in recent years by virtually all major mobile phone manufactures, spectrum subtraction techniques require the speech signals to be converted from the time domain to the spectrum domain and back again. For example, speech signals in the time domain are converted to the spectrum or frequency domain using Discrete Fourier transform or Fast Fourier transform (DFT/FFT) techniques. The signals are then manipulated in the spectrum domain using techniques such as spectrum subtraction and the like. Finally, the signals are converted back into the time domain using reverse DFT/FFT techniques. The amount of noise reduction applied to the spectrum domain is called the noise spectrum estimate, which is obtained during periods of speech that are classified as being noise only.

Therefore, accurate estimates of the noise spectrum are important and vital steps to guarantee a high quality noise reduction to the speech signal that are based on traditional spectrum domain subtraction techniques. Such estimates generally assume that noise is quasi-stationary. That is, it is assumed that noise is not changing or is very slowly changing over a certain short period of time. Using such assumptions, one can monitor the noise spectrum during time periods where there is no talker's speech and only noise is present.

Unfortunately, in the real world noise is rarely time invariant. Consequently, noise spectrum estimates obtained from previous speech samples are generally lagging behind the true noise that is in the current input speech signal. This mismatch produces major quality degradations including unwanted spectrum distortions known as "music tone", which causes the noise reduced speech to sound mechanical or "robotic".

Another difficult problem with ambient noise is the noise type. While traditional noise suppressors reasonably handle stationary/quasi-stationary noises, such prior-art techniques have problems with noises from sources like a secondary talkers, or other dramatically time-varying sources, such as street and restaurant noises.

For voice communication applications, the use of a handset with a single microphone should be largely sufficient. However, due to the poor performances of traditional noise suppression techniques with single source speech, recent trends in the industry is to use dual-microphones or even multi-microphones to maintain a reasonably acceptable performance. Unfortunately, due to the traditional method of performing noise suppression, even with dual-microphone techniques and the associated cost increases, the resulting speech still has the typical artifacts, as described above. Further, under such conditions, the noise suppressors in such prior-art systems generally require relatively long periods of time to converge, which leaves users exposed to the presence of un-removed noises.

Accordingly, the present invention provides improved noise suppression techniques that work well with both single and multi-input speech sources. Further, the present invention alleviates the prior-art degradation problems related to spectrum distortion and provides for much faster converge in order to further improve the user's perceived QoE across all application scenarios.

More particularly, the present invention provides a new and improved method and system that exploits a single or multiple input sources using a long-term noise spectrum estimate that captures the time invariant (slowly variant) part of the noise, and further includes a short-term noise spectrum estimate, which captures the fast more rapidly changing part of the noise. The present invention further includes a selectively applied spectrum gain based shaping technique for reducing noise that completely eliminates artifacts such as "music tone" and other audible and objectionable distortions that are introduced by traditional methods.

The present invention also includes a largely relaxed dependency on an accurate noise spectrum estimates, rending the noise suppressor robust to rapidly changing noise conditions that are common in daily life.

DETAILED DESCRIPTION

The present invention may be described herein in terms of functional block components and various processing steps. It should be appreciated that such functional blocks may be realized by any number of hardware components or software elements configured to perform the specified functions. For example, the present invention may employ various integrated circuit components, e.g., memory elements, digital signal processing elements, logic elements, look-up tables, and the like, which may carry out a variety of functions under the control of one or more microprocessors or other control devices. In addition, those skilled in the art will appreciate that the present invention may be practiced in conjunction with any number of data and voice transmission protocols, and that the system described herein is merely one exemplary application for the invention.

It should be appreciated that the particular implementations shown and described herein are illustrative of the invention and its best mode and are not intended to otherwise limit the scope of the present invention in any way. Indeed, for the sake of brevity, conventional techniques for signal processing, data transmission, signaling, packet-based transmission, network control, and other functional aspects of the systems (and components of the individual operating components of the systems) may not be described in detail herein, but are readily known by skilled practitioners in the relevant arts. Furthermore, the connecting lines shown in the various figures contained herein are intended to represent exemplary functional relationships and/or physical couplings between the various elements. It should be noted that many alternative or additional functional relationships or physical connections may be present in a practical communication system. It should be noted that the present invention is described in terms of a typical mobile phone system. However, the present invention can be used with any type of communication device including non-mobile phone systems, laptop computers, tablets, game systems, desktop computers, personal digital infotainment devices and the like. Indeed, the present invention can be used with any system that supports digital voice communications. Therefore, the use of cellular mobile phones as example implementations should not be construed to limit the scope and breadth of the present invention.

Figure 1:
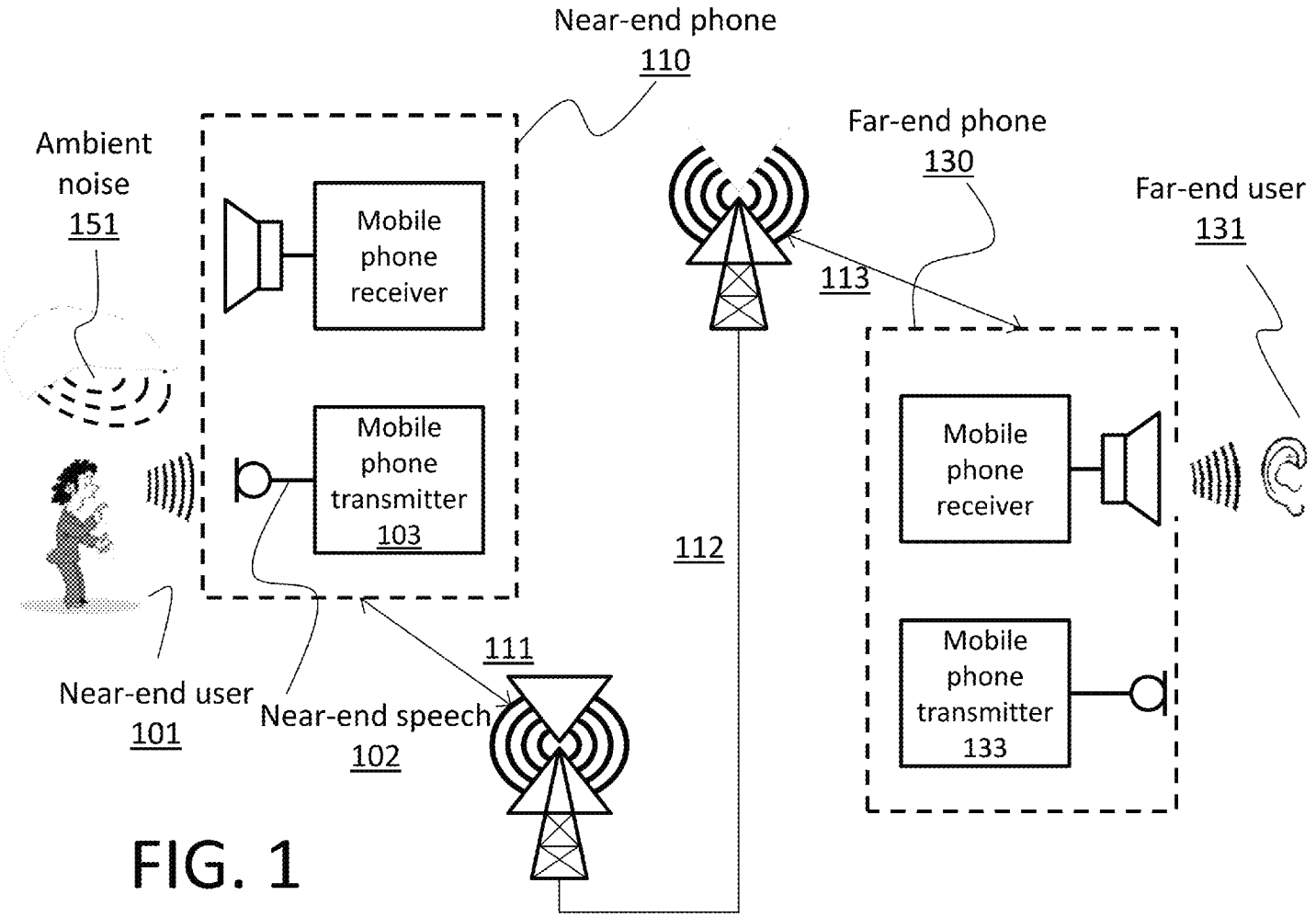
FIG. 1 is an exemplary schematic block diagram representation of a mobile phone communication system in which various aspects of the present invention may be implemented.

FIG. 1 illustrates a typical mobile phone system where two mobile phones, 110 and 130, are coupled together via certain wireless and wireline connectivity represented by the elements 111, 112 and 113. When the near-end talker 101 speaks into the microphone, the speech signal, together with the ambient noise 151, is picked up by the near-end microphone, which produces a near-end speech signal 102. The near-end speech signal 102 is received by the near-end mobile phone transmitter 103, which applies certain compression schemes before transmitting the compressed (or coded) speech signal to the far-end mobile phone 130 via the wireless/wireline connectivity, according to whatever wireless standards the mobile phones and the wireless access/transport systems support. Once received by the far-end mobile phone 130, the compressed speech is converted back to its linear form referred to as reconstructed near-end speech (or simply, near-end speech) before being played back through a loudspeaker or earphone to the far-end user 131.

Figure 2:
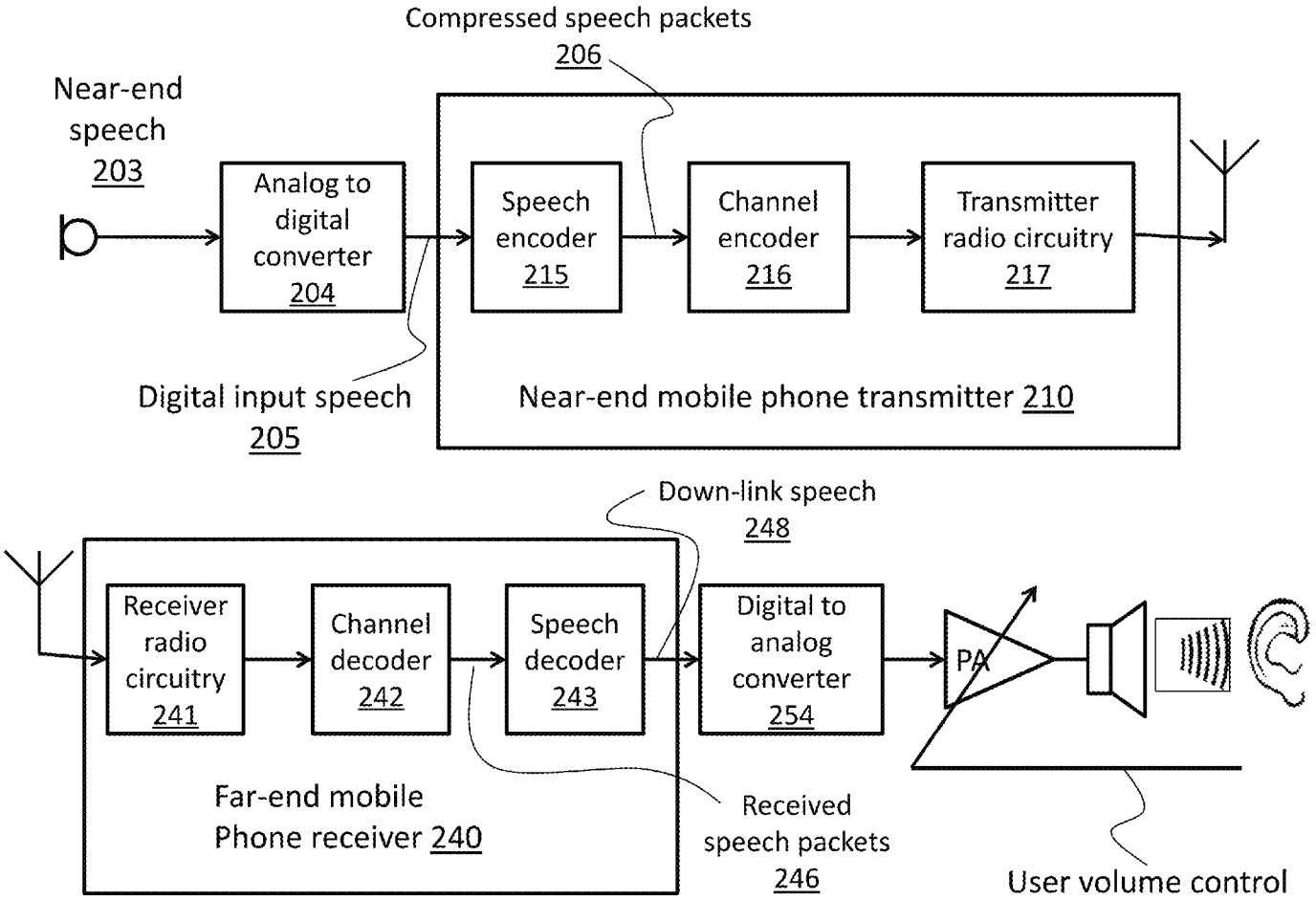
FIG. 2 highlights in more detail exemplary flowcharts of speech transmitter and receiver of a mobile phone communication system.

FIG. 2 is a flow diagram that shows details the relevant processing units inside the near-end mobile phone transmitter and the far-end mobile phone receiver in accordance with one example embodiment of the present invention. The near-end speech 203 is received by an analog to digital convertor 204, which produces a digital form 205 of the near-end speech. The digital speech signal 205 is fed into the near-end mobile phone transmitter 210. A typical near-end mobile phone transmitter will now be described in accordance with one example embodiment of the present invention. First, the digital input speech 205 is compressed by the speech encoder 215 in accordance with whatever wireless speech coding standard is being implemented. Next, the compressed speech packets 206 go through a channel encoder 216 to prepare the packets 206 for radio transmission. The channel encoder is coupled with the transmitter radio circuitry 217 and is then transmitted over the near-end phone's antenna.

On the far-end phone, the reverse processing takes place. The radio signal containing the compressed speech is received by the far-end phone's antenna in the far-end mobile phone receiver 240. Next, the signal is processed by the receiver radio circuitry 241, followed by the channel decoder 242 to obtain the received compressed speech, referred to as speech packets or frames 246. Depending on the speech coding scheme used, one compressed speech packet can typically represent 5-30 ms worth of a speech signal. After the speech decoder 243, the reconstructed speech (or down-link speech) 248 is output to the digital to analog convertor 254.

Due to the never ending evolution of wireless access technology, it is worth mentioning that the combination of the channel encoder 216 and transmitter radio circuitry 217, as well as the reverse processing of the receiver radio circuitry 241 and channel decoder 242, can be seen as wireless modem (modulator-demodulator). Newer standards in use today, including LTE, WiMax and WiFi, and others, comprise wireless modems in different configurations than as described above and in FIG. 2. The use of the example wireless modems are shown for simplicity sake and are examples of one embodiment of the present invention. As such, the use of such examples should not be construed to limit the scope and breadth of the present invention.

Figure 3:
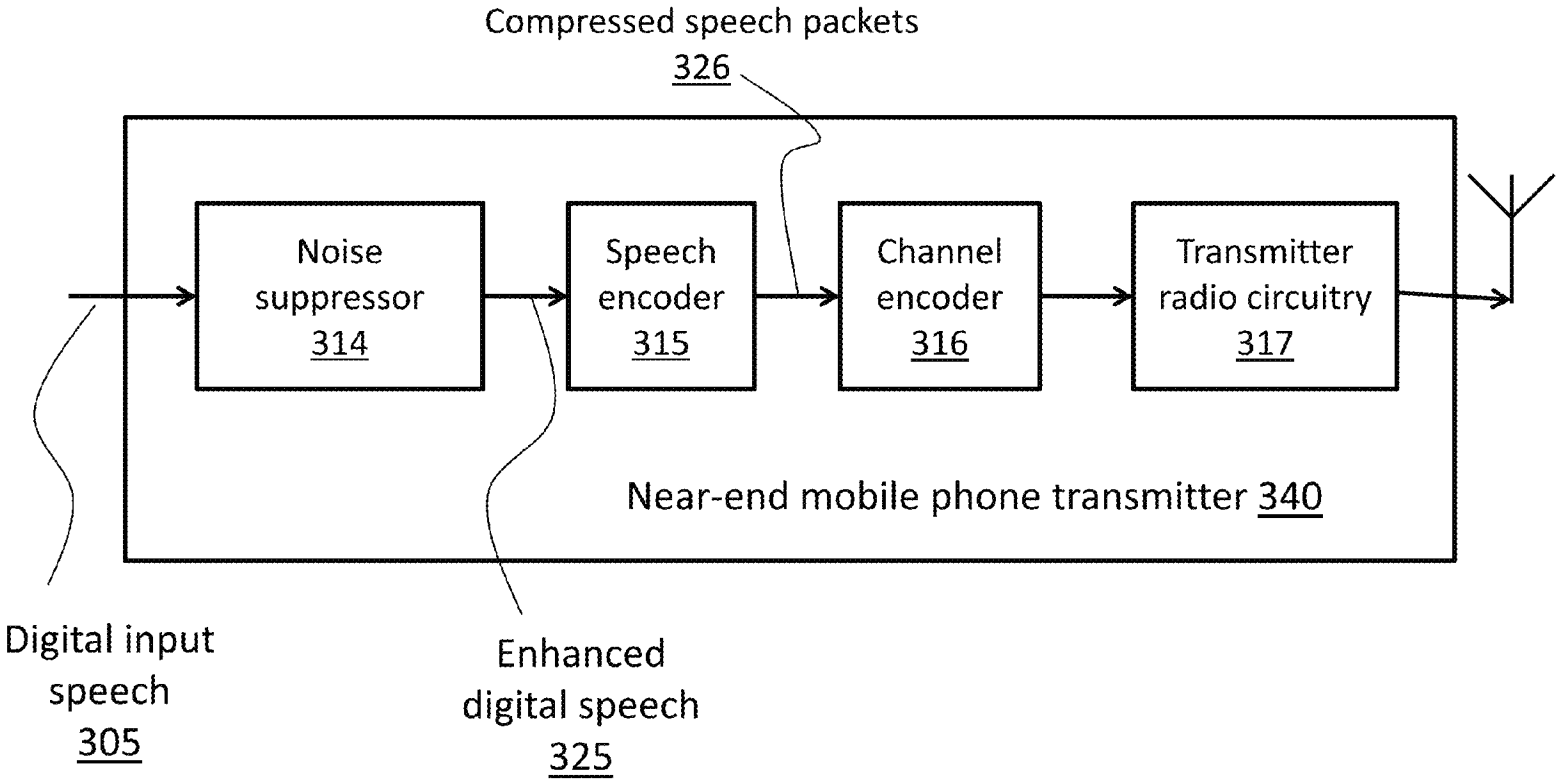
FIG. 3 illustrates the use of an exemplary noise suppressor module in the speech transmitter.

FIG. 3 illustrates one embodiment of the present invention, and in particular, illustrates the case when a noise suppressor 314 is used in the near-end phone's transmitting path. The digital input speech signal(s) 305 from a single or a multi-microphone system is fed into the noise suppressor 314 to produce an enhanced digital speech 325.

The enhanced digital speech signal 325 is next fed into the speech encoder 315. The enhanced digital speech 325 is compressed by the speech encoder 315 in accordance with whatever wireless speech coding standard is being implemented. Next, the enhanced compressed speech packets 326 go through a channel encoder 316 to prepare the packets for radio transmission. The channel encoder is coupled with the transmitter radio circuitry 317 and is then transmitted over the near-end phone's antenna.

Figure 4:
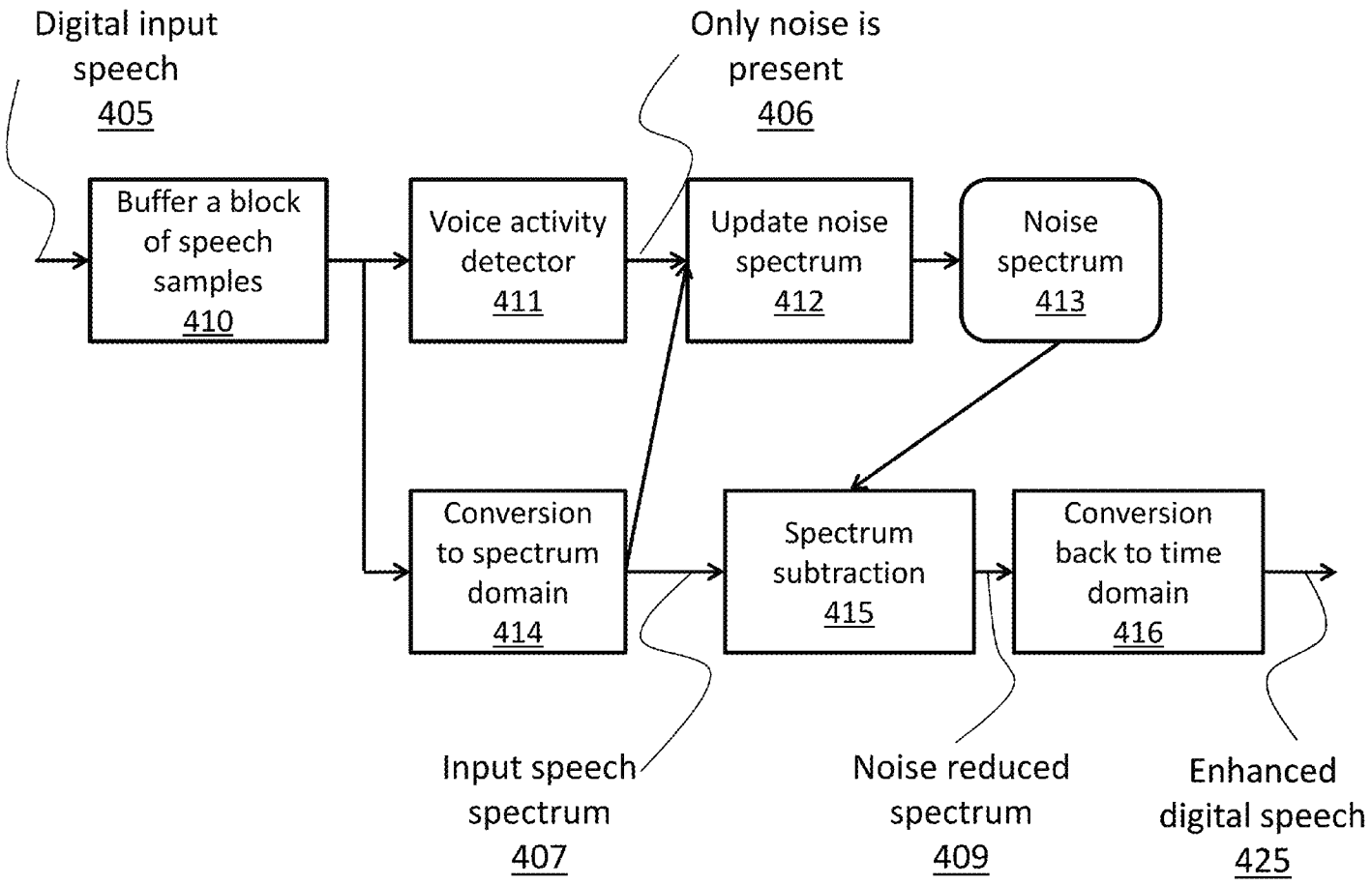
FIG. 4 (Prior Art)
FIG. 4 illustrates a typical traditional noise suppressor based on spectrum subtraction technique.

FIG. 4 illustrates a typical traditional noise suppressor based on spectrum manipulation/subtraction. Traditional noise suppression techniques are almost all based on spectrum manipulation known as spectrum subtraction. The principle behind such techniques is that, while speech and noise are only truly additive in the time domain, when the noise level is much lower than that of the speech signal, the cross-term in the spectrum domain is negligible, therefore speech and noise can also be approximated to be additive in the spectrum domain. It is further assumed that, while changing over time, noise is quasi-stationary. That is, it is assumed that noise is not changing or is very slowly changing over a certain short periods of time. Using such assumptions, one can monitor the noise spectrum during time periods where there is no near-end talker's speech, (i.e., times when only noise is present). Noise suppression is achieved by subtracting the noise spectrum from the input spectrum, with or without the near-end talker's speech. This principle is illustrated in greater detail with reference to FIG. 4.

Referring now to FIG. 4, digital input speech 405 is input into a speech sample buffer 410. The speech samples, which contain speech and noise, are then converted into the spectrum or frequency domain 414. At the same time a VAD or voice activity detector 411, is used to detect time periods when no speech is present (i.e. only noise is present 406). The noise spectrum update module 412 takes spectrum from noise only periods and generates an updated noise spectrum 413, whenever it is possible. In parallel, the noise spectrum 413 is subtracted from the input speech spectrum 407 by the spectrum manipulation module 415 to generate a noise reduced spectrum 409. Finally, enhanced digital speech 425 is obtained by converting the noise reduced spectrum 409 back to the time domain by the module 416.

While such prior-art techniques using spectrum manipulation, as discussed above, can effectively remove the noise from the speech signal to produce an enhanced speech output, it has some well-known drawbacks. First, quasi-stationary noises do exist, but the large majority of real-life application conditions include noises that are rapidly changing. This fact results in an inevitable mismatch between the estimated noise spectrum and the actual noise spectrum. In addition, even when real-life quasi-stationary noises are present, there are inevitable signal variations at the millisecond level, resulting in local spectrum mismatch, which produces the well known "music tone" effect in the reproduced speech. Finally, when noise spectrum estimates accidentally include non-noise periods, i.e., when the voice-activity-detector misclassifies speech segments as noise, which corrupts the noise spectrum estimate 412, the spectrum manipulation 415 creates audible spectrum distortion in the output speech 425. With such unavoidable drawbacks, even though the noise might be largely reduced by such noise suppressors, the output speech 425 often sounds mechanical or has obvious artifacts that are objectionable to the human auditory system.

It should also be noted that multiple microphones are sometimes used to increase the detection accuracy and/or improve the noise spectrum estimate. From a signal processing point of view, having more reference data helps the detection accuracy. However, when the noise signal behavior inherently prevents the accurate detection of the true noise spectrum, such as fast changing noise having local spectrum variations, such traditional solutions still result in degraded output speech, This is true, even for conventional systems using multiple microphones.

In addition, traditional methods require accurate estimates of the noise spectrum. Such accurate estimates can only be obtained through certain periods of observation, known as the training or convergence period. Before the noise spectrum estimate is converged, zero or very little noise suppression is performed on the speech, leaving users to experience a large variation of residual noises. For example, users generally experience loud residual noises when the noise spectrum estimate is not converged, followed by low residual noise when the convergence is reached. In addition, this condition repeats whenever noise conditions change. That is, during the reconvergence periods, users again are exposed to loud residual noises followed by low residual noises until reconvergence is achieved.

Figure 5:
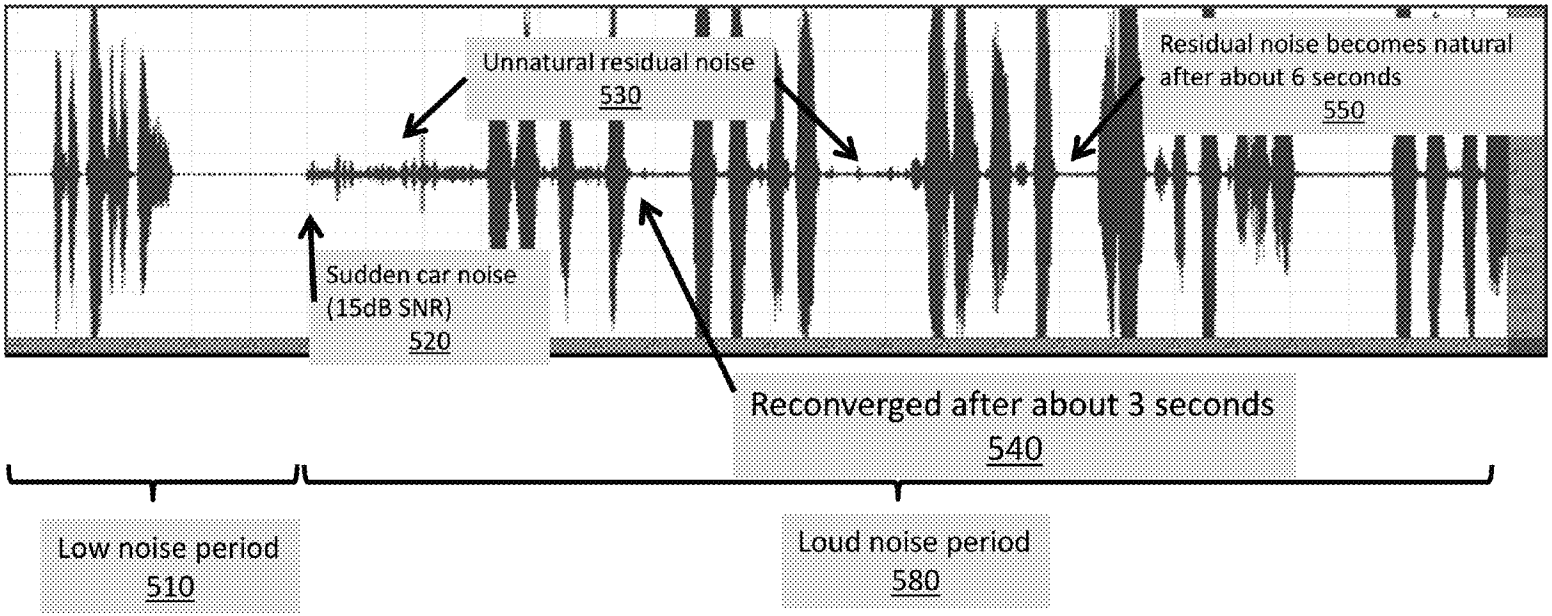
FIG. 5 shows the poor performance of a conventional dual-microphone noise suppressor during noise changing conditions.

FIG. 5 shows the poor performance of a conventional dual-microphone noise suppressor during noise changing conditions. The first part of the speech signal comprises very low ambient noise levels 510 and as such, very clean residual noise is present in the output speech. The point shown with reference to 520 represents the sudden appearance of a load car noise. As shown, residual noises from the conventional noise suppressor is quite obvious in volume, as well as the audible unnatural noises as shown at 530. Using such conventional systems, it takes about 3 seconds for the noise spectrum estimate to converge as shown at 540. After that point, the residual noise is reasonably small, but it still takes about another 3 seconds or so, for the residual noise to become reasonably natural as shown at point 550.

It should be noted that in a typical dual-microphone configuration used on mobile phones, the main microphone (herein after referred to as "main-mic") is placed close to the talker's mouth at the bottom of the phone. Thus, compared with the secondary microphone ("second-mic"), it picks up a much louder voice signal. The second-mic is usually placed at the opposite side of the phone, either on the top or the back, and therefore is only able to pick up the talker's voice at a reduced volume level. However, since ambient noises are generally from sources that are relatively far away from the phone, it is reasonable to assume that both microphones pick up the noises at comparable levels.

While the difference between the two microphone inputs have been used to improve voice activity detection in conventional systems, by improving the noise spectrum estimate, the present invention takes this concept much further to provide a dramatically improved noise suppression technique. Specifically, the present invention further exploits the high correlation between the input signals from the two microphones as follows. The present invention uses the traditional noise spectrum estimate from the main microphone or both microphones as a long-term estimate of the noise (i.e., that part of the noise that is reasonably close to time invariant, or at least quasi-time-invariant), and additionally uses the secondary microphone's input signal spectrum as a short-term estimate of the noise. The present invention uses the short-term estimate, assuming it to be rapidly time varying, such as the case of a close-by interference talker, where the noise is actually someone else's voice. Because the secondary microphone input speech also contains the talker's voice, a straight-forward spectrum subtraction method should not be used.

Figure 6A:
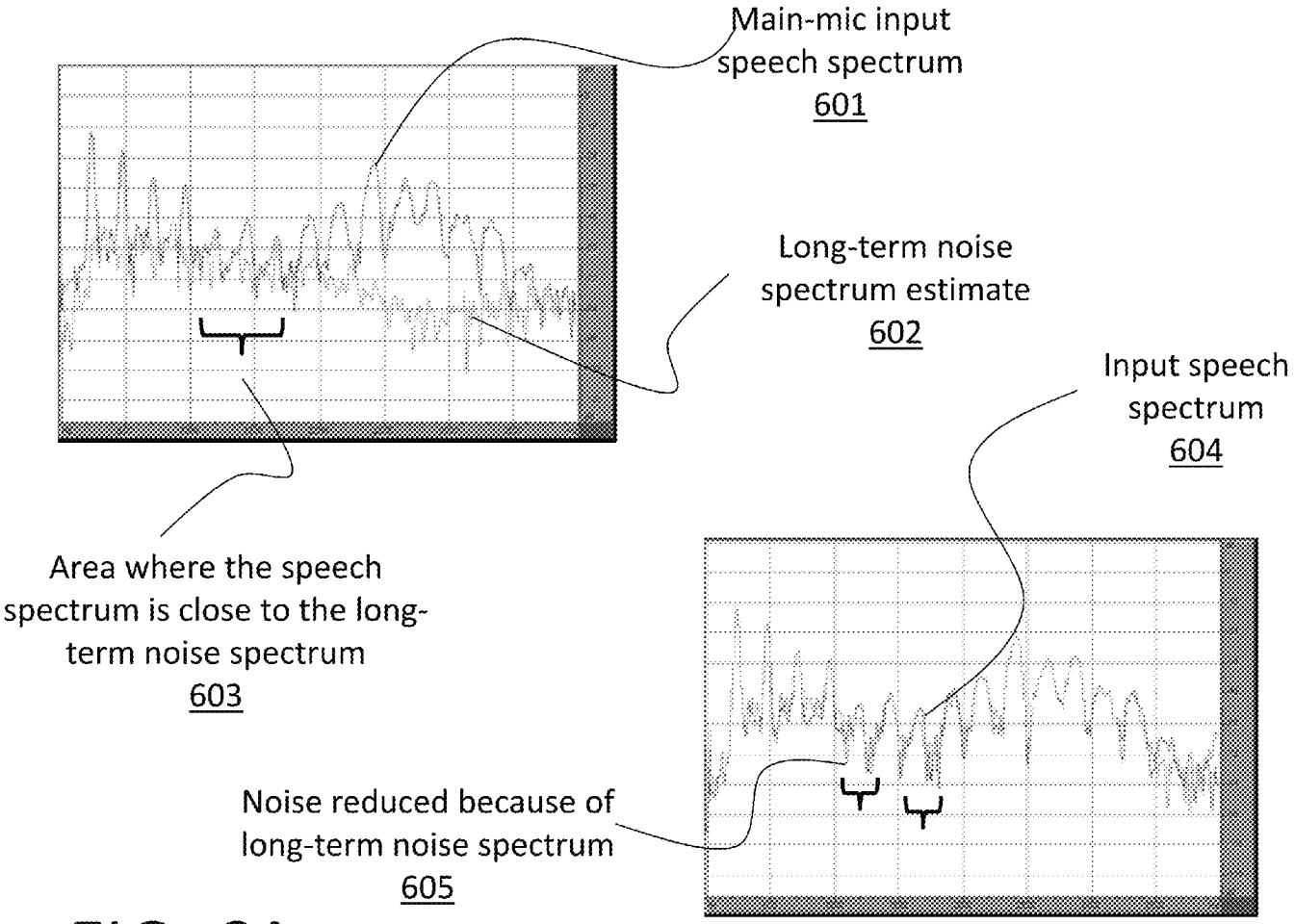
FIGS. 6A/6B/6C show speech spectrum manipulations of an exemplary multi-input noise suppressor in accordance with the present invention.

FIG. 6A depicts an example of a spectrum domain manipulation in accordance with one embodiment of the present invention for a voiced segment. For frequency areas where the main-mic input speech spectrum 601 is larger than the long-term noise spectrum 602 by a certain threshold, no spectrum change is performed. However, for areas 603 where the main-mic input speech and the long-term noise spectrum are close by a certain predetermined threshold, some reduction of main-mic input speech spectrum areas 605 is applied to produce a noise reduced speech spectrum.

Figure 6B:
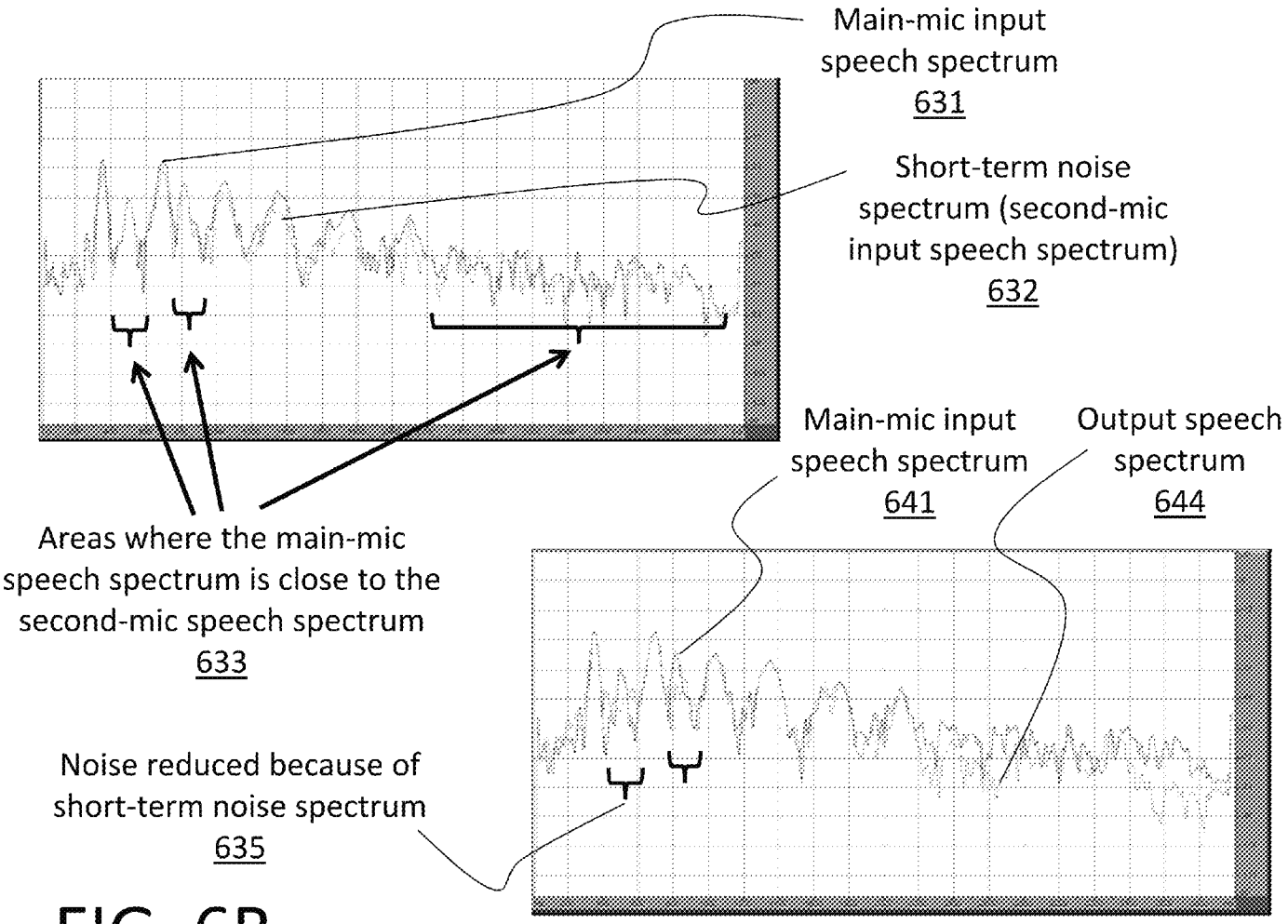

FIG. 6B depicts another example of spectrum domain manipulation in accordance with the present invention for yet another voiced segment. For frequency areas where the main-mic input speech spectrum 631 is close to the short-term noise spectrum 632 (or the second-mic input speech spectrum), by a certain predetermined threshold, some reduction of main-mic input speech spectrum areas 635 is applied to produce a noise reduced speech spectrum 635. The noise reduction caused by short-term or long-term noise spectrum is performed by reducing the amplitude, or energy, of the corresponding spectrum at those frequency areas by a predetermined factor, the shaping gain factor. It should be noted that this is unlike conventional methods of spectrum manipulation that is performed by subtracting the noise spectrum from the input speech spectrum. Another advantage of the present invention over conventional spectrum subtraction methods, is that when there is no noise (or a very low noise), there is no impact to the talker's voice in the main-mic speech, because the input speech from the talker is always at a lower level at the second-mic, as compared to the main-mic.

Figure 6C:
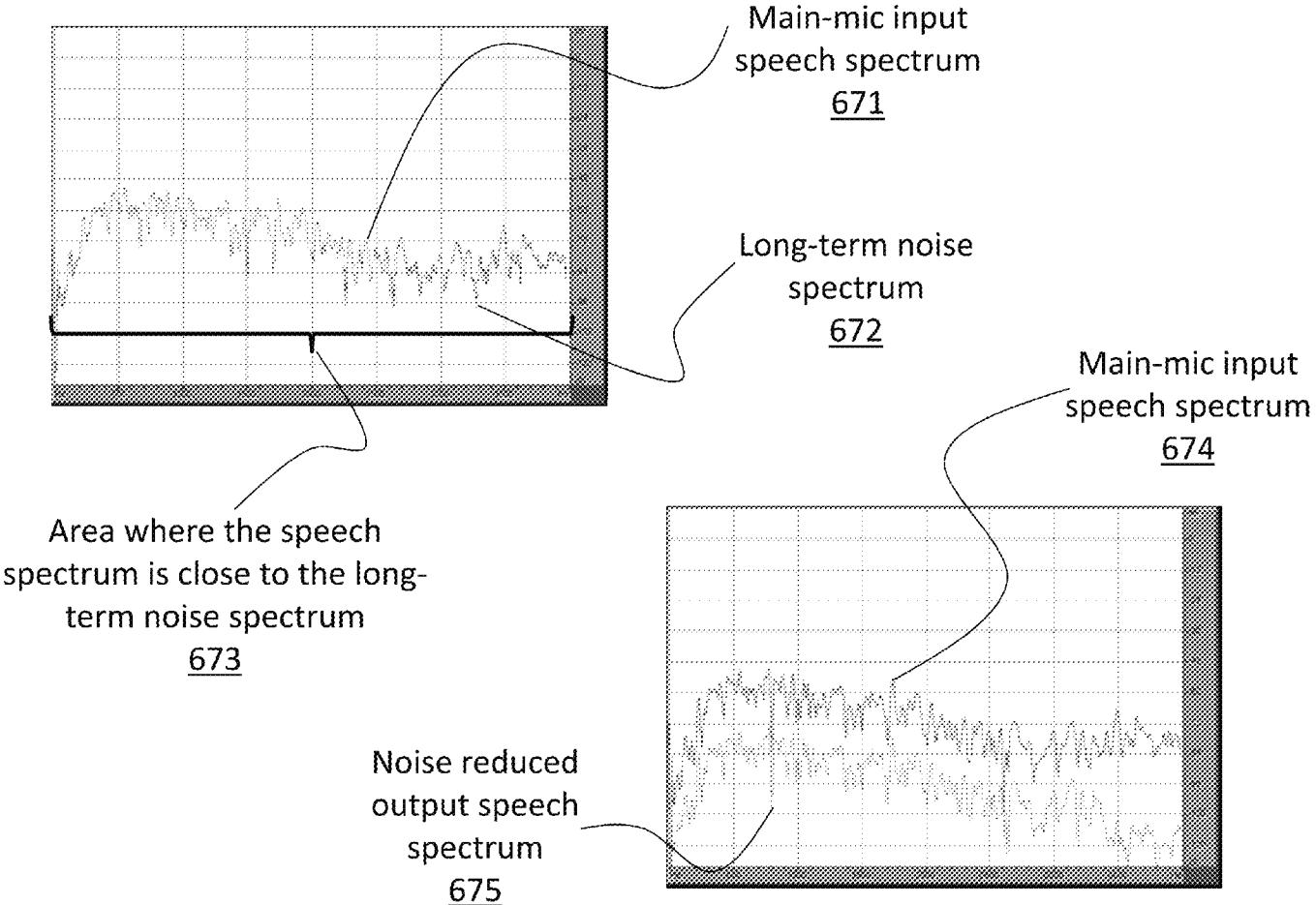

FIG. 6C shows another example of a spectrum domain manipulation in accordance with the present invention for a non-voiced segment. It can be seen that a more aggressive shaping factor is used for unvoiced speech segments resulting in large differences in the spectrum domain between the input speech and output speech. The advantage of such a selective spectrum gain-based shaping technique of the present invention is that no unwanted "music tone" or audible artifacts are created.

It is noted that that the term "main-mic input speech" can also refer to a certain combination of the input speech from the two or multiple microphones. Similarly that "second-mic input speech" can also refer to a certain combination of the secondary microphone input speech with the main-microphone input speech, or the secondary microphone input speech with other multiple microphone input speech signals.

Figure 7:
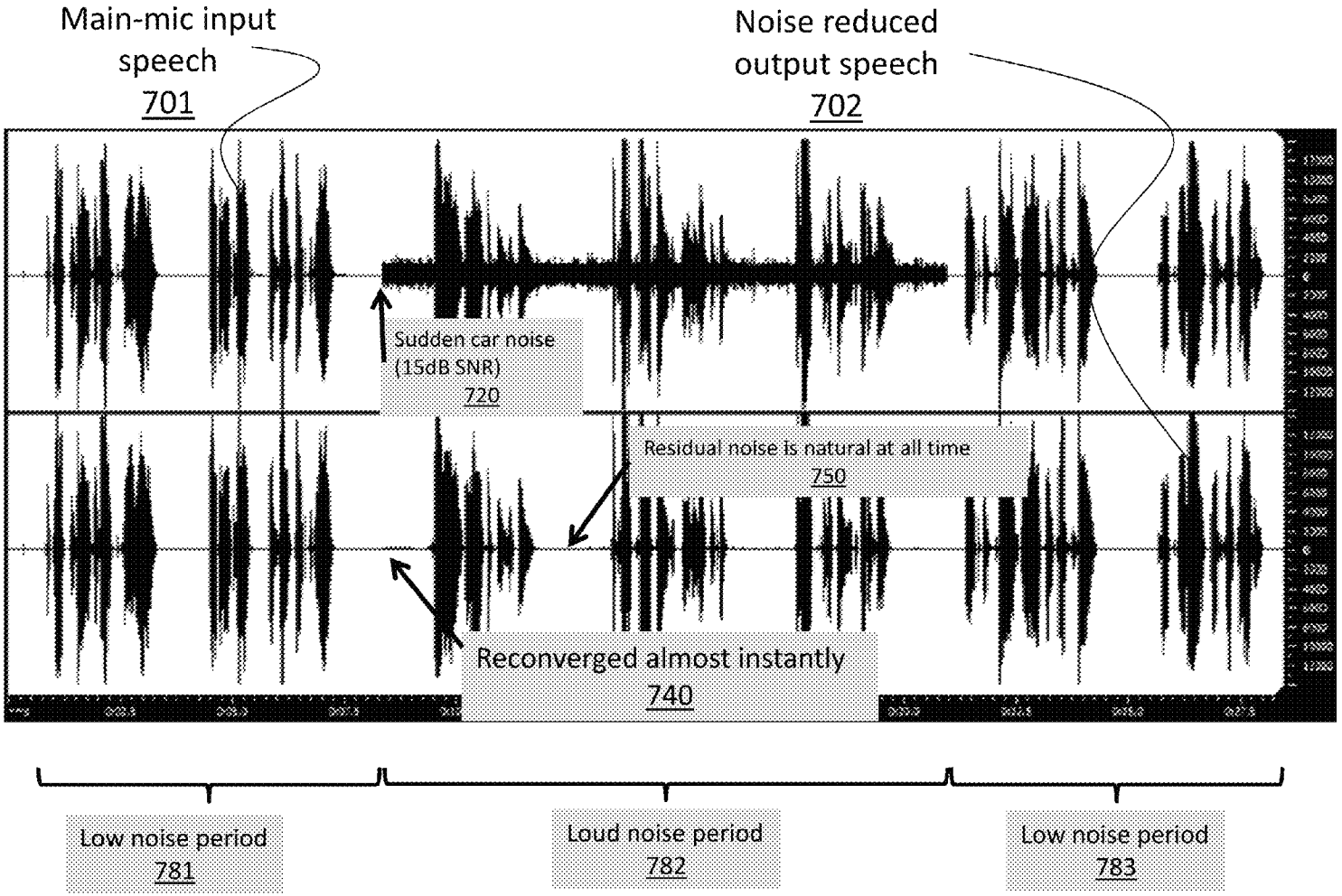
FIG. 7 illustrates the performance during a typical noise changing condition of an exemplary multi-input noise suppressor in accordance with the present invention.

FIG. 7 shows two speech waveforms demonstrating an advantage of present invention. Referring now to the main-mic input speech 701. As shown at the beginning of the waveform 701, the noise levels are low during the low noise period 781. Next, a loud car noise appears as shown at 720 during a period of time represented by time period 782. The noise that began at 720 disappears or diminishes during the low noise period shown at 783. In the noise reduced output speech waveform 702, the absence of a loud residual noise during the sudden noise increase at the input clearly shows the virtual instantaneous convergence of the noise suppressor 740 of the present invention. In addition, the absence of any audible artifacts is another significant benefit of the present invention as shown by 750.

Figure 8:
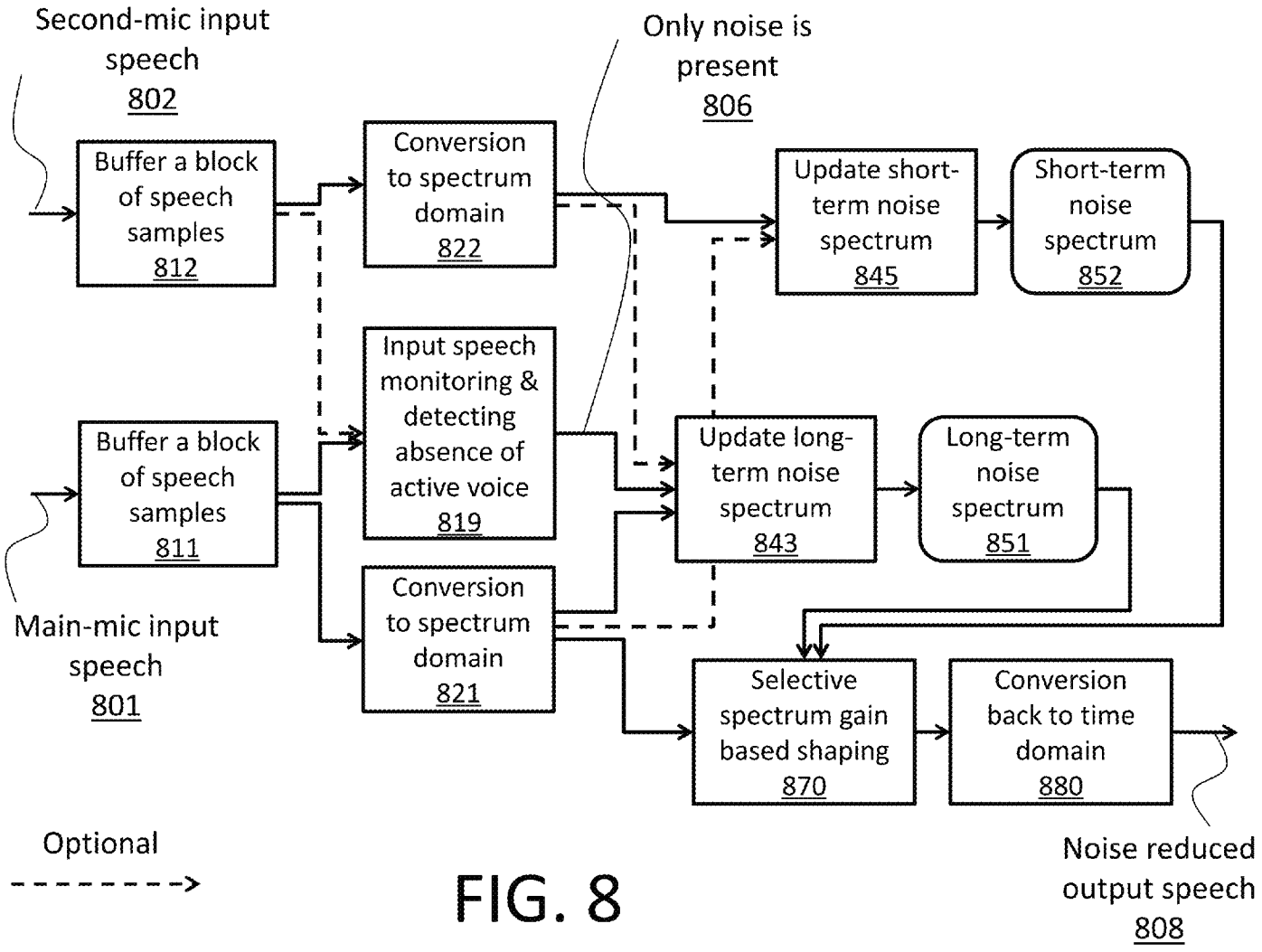
FIG. 8 depicts an exemplary implementation of a multi-input noise suppressor in accordance with the present invention.

FIG. 8 depicts an exemplary implementation of the present invention. Input speech from the main-mic and second-mic 801/802 are buffered into blocks of speech 811/812. A noise monitoring module 819 first analyses the input speech signal to determine the absence of an active voice signal. The input speech is also converted to the spectrum domain by techniques such as DFT/FFT 821/822. For segments that are classified as noise only 806, the input speech spectrum from the main-mic (and from the second-mic as an option) is used to update the long-term noise spectrum estimate by the updating module 843 in order to produce the long-term noise spectrum 851. The second-mic input speech spectrum (and the main-mic input speech spectrum as an option) is used to update the short-term noise spectrum 845 to produce the short-term noise spectrum 852.

In parallel, the input speech spectrum from the main-mic is compared with the long-term and short-term noise spectra, and a selective spectrum gain based shaping is performed 870 where input speech spectrum is close to either the long-term or short-term noise spectrum according to a predetermined threshold. The noise reduced output speech 808 is obtained by converting the modified input speech spectrum back to the time domain 880.

In a preferred embodiment of the present invention the predetermined threshold and the applied gain may differ depending on the various aspects of the speech signals and the design goals of the specific implementation of the present invention. For example, the predetermined threshold and/or the applied gain may differ for voiced and un-voiced segments, for highly voiced segments and weakly voiced segments, for signal level dependent and noise level dependent segments, and even for different frequencies in the spectrum domain. Any and all such variations may be implemented without departing from the scope and breadth of the present invention.

As stated, the present invention may be implemented using multiple microphones or a single microphone. The single microphone implementation will now be described with reference to FIGS. 9A, 9B and 10.

Figure 9A:
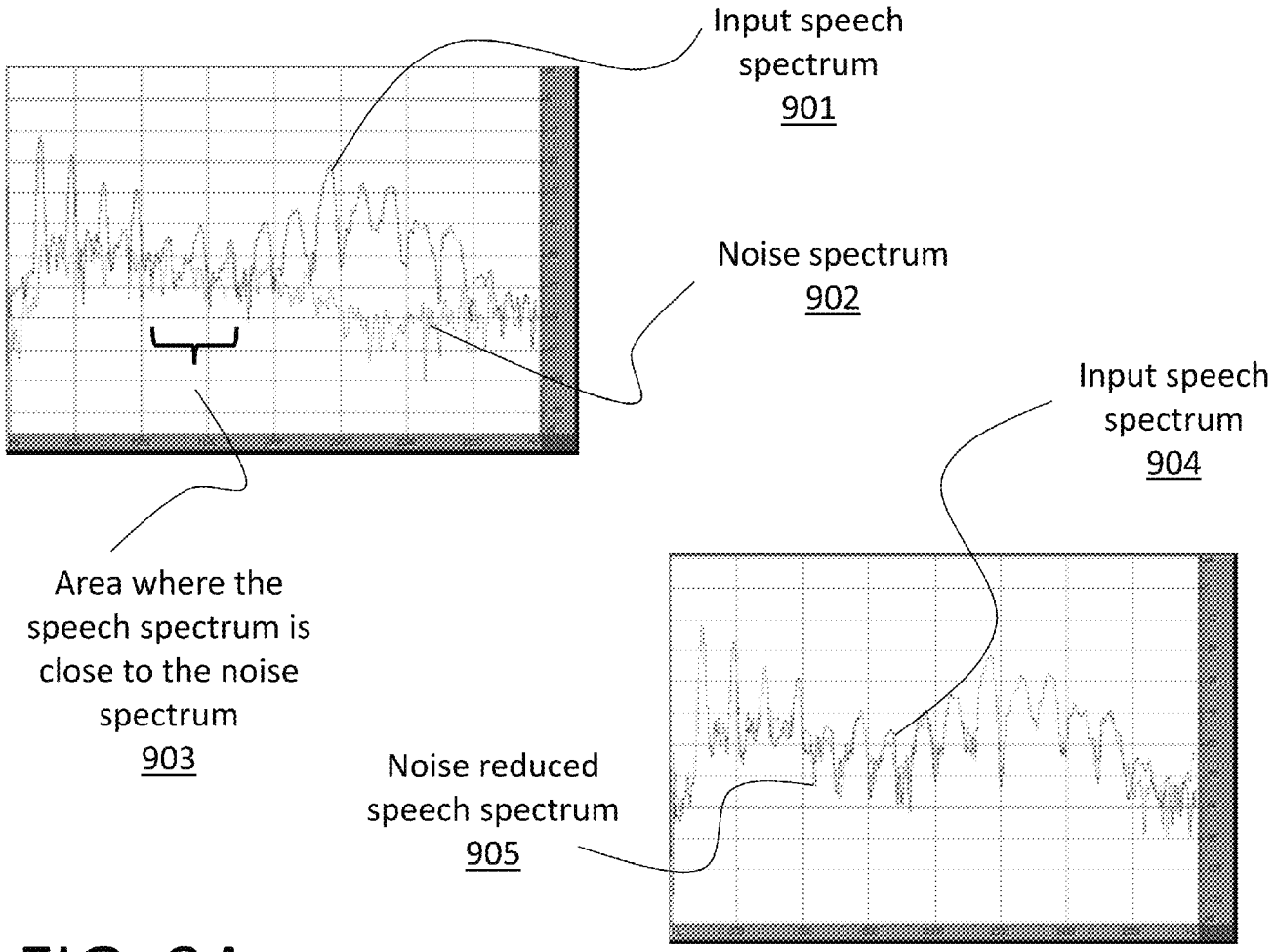
FIGS. 9A and 9B show speech spectrum manipulations of an exemplary single-input noise suppressor in accordance with the present invention.

FIG. 9A depicts an example spectrum domain manipulation in accordance with a single microphone input implementation of the present invention for a voiced segment. For frequency areas where the input speech spectrum 901 is larger than the noise spectrum 902, no spectrum change is performed, but for area 903 where the input speech spectrum is close to the noise spectrum by a certain predetermined threshold, some reduction of input speech spectrum is applied to produce a noise reduced speech spectrum 905. This reduction is performed by reducing the amplitude, or energy, of the corresponding spectrum at those frequency areas by a predetermined factor, the shaping gain factor. This is in contrast with the conventional method of subtracting the noise spectrum from the input speech spectrum.

Figure 9B:
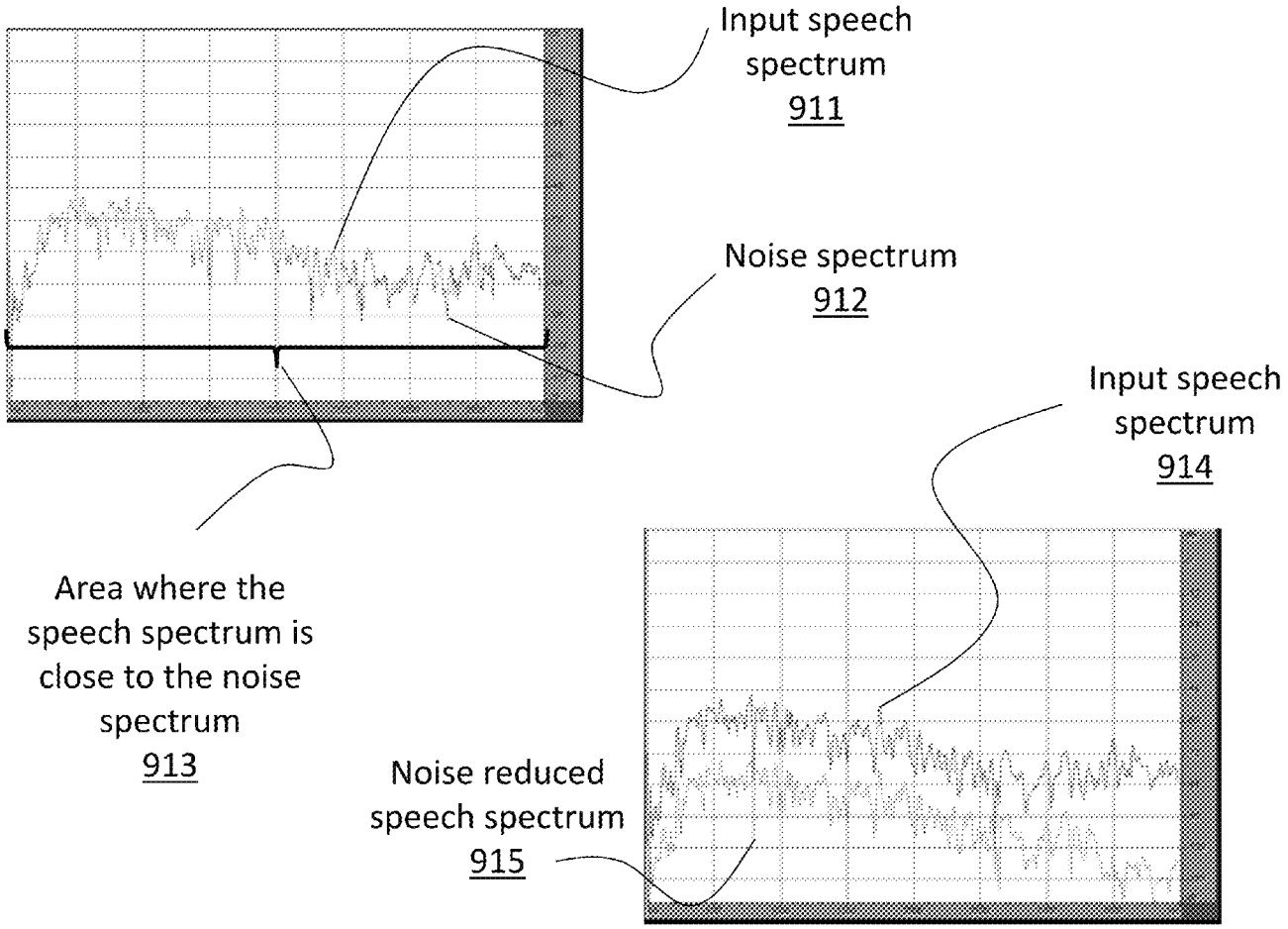

FIG. 9B depicts another example spectrum domain manipulation in accordance with a single microphone input implementation of the present invention for a non-voiced segment. As shown by 911 and 912, the input speech and noise spectrums are very close. Further, as shown by the noise reduced speech spectrum 915, a more aggressive shaping factor is used for the unvoiced speech segment resulting in a large difference in the spectrum domain. The advantage of such a selective spectrum gain based shaping is that no unwanted "music tone" or audible artifacts are created.

Figure 10:
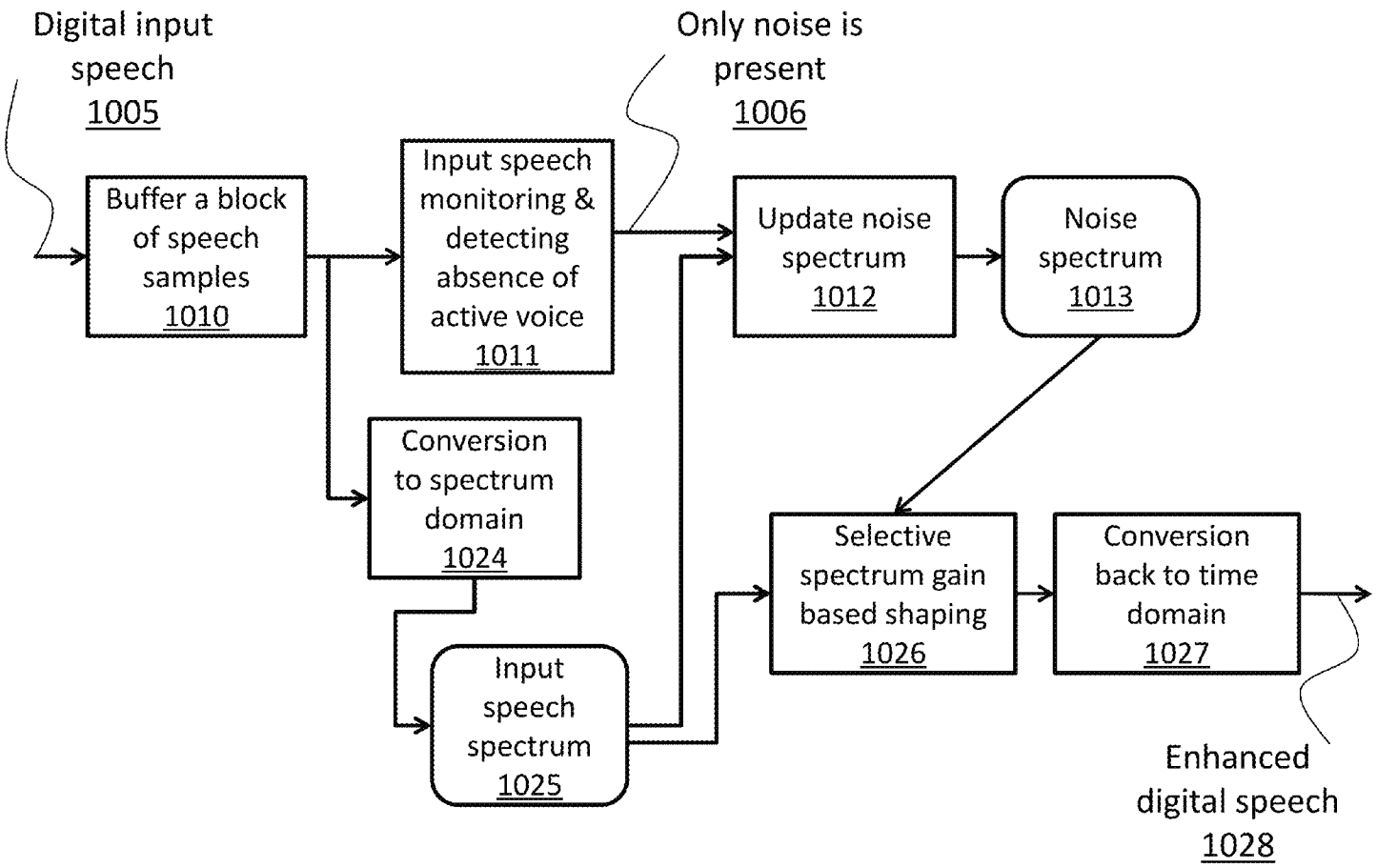
FIG. 10 depicts an exemplary implementation of a single-input noise suppressor in accordance with the present invention.

FIG. 10 depicts an exemplary implementation of a single microphone embodiment of the present invention. A noise monitoring module 1011 first analyzes the input speech signal to determine the absence of active speech signal. The input speech is also converted to the spectrum domain by techniques such as DFT/FFT 1024. For segments that are classified as noise only 1006, the input speech spectrum 1025 is used to update the noise spectrum estimate by the updating module 1012 in order to produce a noise spectrum 1013. In parallel, the input speech spectrum 1025 is compared with the noise spectrum 1013, and a selective spectrum gain based shaping is performed in module 1026, where input speech spectrum is close to the noise spectrum according to a predetermined threshold. The output noise reduced speech 1028 is obtained by converting the modified input speech spectrum back to the time domain 1027.

In a preferred embodiment of the present invention the predetermined threshold and the applied gain may differ depending on the various aspects of the speech signals and the design goals of the specific implementation of the present invention. For example, the predetermined threshold and/or the applied gain may differ for voiced and un-voiced segments, for highly voiced segments and weakly voiced segments, for signal level dependent and noise level dependent segments, and even for different frequencies in the spectrum domain. Any and all such variations may be implemented without departing from the scope and breadth of the present invention.

Figure 11:
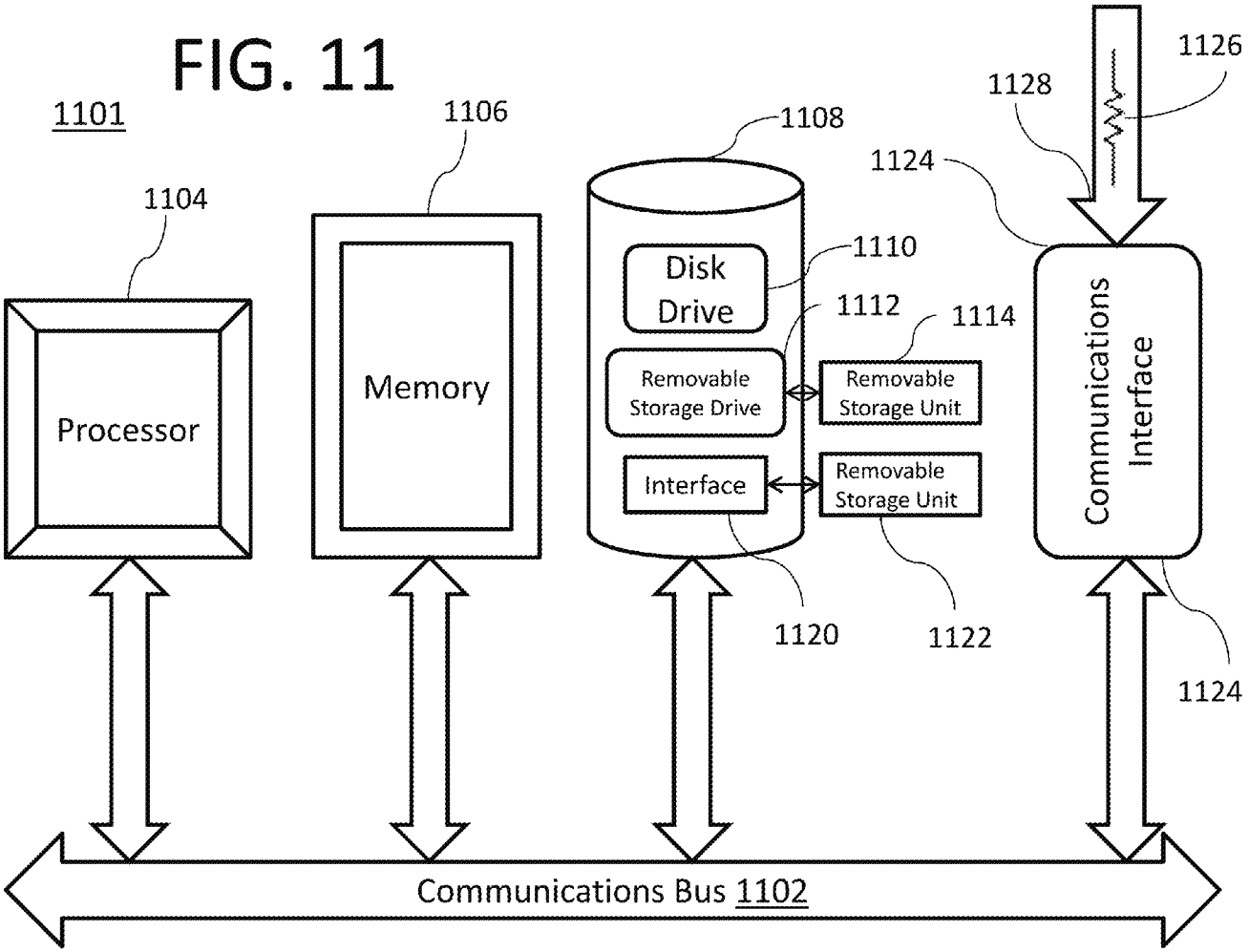
FIG. 11 illustrates a typical computer system capable of implementing an example embodiment of the present invention.

The present invention may be implemented using hardware, software or a combination thereof and may be implemented in a computer system or other processing system. Computers and other processing systems come in many forms, including wireless handsets, portable music players, infotainment devices, tablets, laptop computers, desktop computers and the like. In fact, in one embodiment, the invention is directed toward a computer system capable of carrying out the functionality described herein. An example computer system 1101 is shown in FIG. 11. The computer system 1101 includes one or more processors, such as processor 1104. The processor 1104 is connected to a communications bus 1102. Various software embodiments are described in terms of this example computer system. After reading this description, it will become apparent to a person skilled in the relevant art how to implement the invention using other computer systems and/or computer architectures.

Computer system 1101 also includes a main memory 1106, preferably random access memory (RAM), and can also include a secondary memory 1108. The secondary memory 1108 can include, for example, a hard disk drive 1110 and/or a removable storage drive 1112, representing a magnetic disc or tape drive, an optical disk drive, etc. The removable storage drive 1112 reads from and/or writes to a removable storage unit 1114 in a well-known manner. Removable storage unit 1114, represent magnetic or optical media, such as disks or tapes, etc., which is read by and written to by removable storage drive 1112. As will be appreciated, the removable storage unit 1114 includes a computer usable storage medium having stored therein computer software and/or data.

In alternative embodiments, secondary memory 1108 may include other similar means for allowing computer programs or other instructions to be loaded into computer system 1101. Such means can include, for example, a removable storage unit 1122 and an interface 1120. Examples of such can include a USB flash disc and interface, a program cartridge and cartridge interface (such as that found in video game devices), other types of removable memory chips and associated socket, such as SD memory and the like, and other removable storage units 1122 and interfaces 1120 which allow software and data to be transferred from the removable storage unit 1122 to computer system 1101.

Computer system 1101 can also include a communications interface 1124. Communications interface 1124 allows software and data to be transferred between computer system 1101 and external devices. Examples of communications interface 1124 can include a modem, a network interface (such as an Ethernet card), a communications port, a PCMCIA slot and card, etc. Software and data transferred via communications interface 1124 are in the form of signals which can be electronic, electromagnetic, optical or other signals capable of being received by communications interface 1124. These signals 1126 are provided to communications interface via a channel 1128. This channel 1128 carries signals 1126 and can be implemented using wire or cable, fiber optics, a phone line, a cellular phone link, an RF link, such as WiFi or cellular, and other communications channels.

In this document, the terms "computer program medium" and "computer usable medium" are used to generally refer to media such as removable storage device 1112, a hard disk installed in hard disk drive 1110, and signals 1126. These computer program products are means for providing software or code to computer system 1101.

Computer programs (also called computer control logic or code) are stored in main memory and/or secondary memory 1108. Computer programs can also be received via communications interface 1124. Such computer programs, when executed, enable the computer system 1101 to perform the features of the present invention as discussed herein. In particular, the computer programs, when executed, enable the processor 1104 to perform the features of the present invention. Accordingly, such computer programs represent controllers of the computer system 1101.

In an embodiment where the invention is implemented using software, the software may be stored in a computer program product and loaded into computer system 1101 using removable storage drive 1112, hard drive 1110 or communications interface 1124. The control logic (software), when executed by the processor 1104, causes the processor 1104 to perform the functions of the invention as described herein.

In another embodiment, the invention is implemented primarily in hardware using, for example, hardware components such as application specific integrated circuits (ASICs). Implementation of the hardware state machine so as to perform the functions described herein will be apparent to persons skilled in the relevant art(s).

In yet another embodiment, the invention is implemented using a combination of both hardware and software.

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What is claimed is:

1. A method for improving the quality of a voice call over a communication link using a communication device having a single microphone for receiving a near-end voice signal and a near-end noise signal, the method comprising the steps of:

receiving an input audio signal from the microphone;

relaxedly classifying said input audio signal as a noise-only signal, if an approximate determination is made that an active-speech signal is not present;

converting said input audio signal into an input audio spectrum;

updating a noise spectrum with said input audio spectrum, if said classifying step results in said noise-only signal;

comparing said input audio spectrum with said noise spectrum;

creating a noise-reduced spectrum by multiplying a predetermined gain shaping factor with said input audio spectrum, if said input audio spectrum is within a predetermined threshold from said noise spectrum or below said noise spectrum;

converting said noise-reduced spectrum to a time domain noise-reduced audio signal; and outputting said noise-reduced audio signal to a user.

2. A non-transitory computer program product comprising a computer useable medium having computer program logic stored therein, said computer program logic for enabling a computer processing device to improve the quality of a voice call over a communication link using a communication device having a single microphone for receiving a near-end voice signal and a near-end noise signal, the method comprising the steps of:

code for receiving an input audio signal from the microphone;

code for relaxedly classifying said input audio signal as a noise-only signal, if an approximate determination is made that an active-speech signal is not present;

code for converting said input audio signal into an input audio spectrum;

code for updating a noise spectrum with said input audio spectrum, if said classifying step results in said noise-only signal;

code for comparing said input audio spectrum with said noise spectrum; and code for creating a noise-reduced spectrum by multiplying a predetermined gain shaping factor with said input audio spectrum, if said input audio spectrum is within a predetermined threshold from said noise spectrum or below said noise spectrum; and code for converting said noise-reduced spectrum to a time domain noise-reduced audio signal; and code for outputting said noise-reduced audio signal to a user.

3. A single-input noise suppressor for improving the quality of a voice call over a communication link using a communication device having a single microphone comprising:

a single microphone for receiving an input audio signal;

a relaxed classifier for relaxedly classifying said input audio signal as a noise-only signal, if an approximate determination is made that an active-speech signal is not present;

a spectrum converter for converting said input audio signal into an input audio spectrum;

a noise-spectrum module for updating a noise spectrum with said input audio spectrum, if said classifying step results in said noise-only signal;

a comparator for comparing said input audio spectrum with said noise spectrum;

a selective spectrum gain based shaping module for creating a noise-reduced spectrum by multiplying a predetermined gain shaping factor with said input audio spectrum, if said input audio spectrum is within a predetermined threshold from said noise spectrum or below said noise spectrum; and a time domain converter for converting said noise-reduced spectrum to a time domain noise-reduced audio signal; and an audio output device for outputting said noise-reduced audio signal to a user.

* * * * *